United States Patent [19]

Schultz

[11] Patent Number: 4,807,897

[45] Date of Patent: Feb. 28, 1989

[54] STANDING SUPPORT

[76] Inventor: Jimmie R. Schultz, 1025 Calle Pecos, Thousand Oaks, Calif. 91360

[21] Appl. No.: 67,601

[22] Filed: Jun. 26, 1987

[51] Int. Cl.[4] ..... A61G 5/02

[52] U.S. Cl. ..... 280/250; 414/921; 5/81 R; 5/83

[58] Field of Search ..... 280/250, 249, 242 WC; 180/907; 414/921; 5/81 R, 81 B, 83, 86

[56] References Cited

U.S. PATENT DOCUMENTS

| | | | |
|---|---|---|---|
| 3,107,105 | 10/1963 | Heriford | 280/250 X |
| 3,493,245 | 2/1970 | Nabinger | 280/250 |
| 3,629,880 | 12/1971 | van Rhyn | 280/250 X |
| 4,545,085 | 10/1985 | Feldt | 5/81 R |

FOREIGN PATENT DOCUMENTS

| | | | |
|---|---|---|---|
| 2164918 | 4/1986 | United Kingdom | 414/921 |

*Primary Examiner*—John A. Pekar

*Attorney, Agent, or Firm*—Fulwider, Patton, Rieber, Lee & Utecht

[57] ABSTRACT

A standing support having a truncated lower horizontal side frame member has an extension flange mounted thereon to laterally displace the drive wheel assembly outward relative the side frame member to widen the rear facing cavity defined therebetween. A cantilevered floor pan configuration removes transverse obstructions between the side frame members to allow the further longitudinal insertion of a conventional wheelchair within the cavity therebetween. A hand crank assembly mounted to the main frame aids in the transfer of the handicapped user from the conventional wheelchair to the improved standing support of the present invention.

18 Claims, 2 Drawing Sheets

FIG. 6
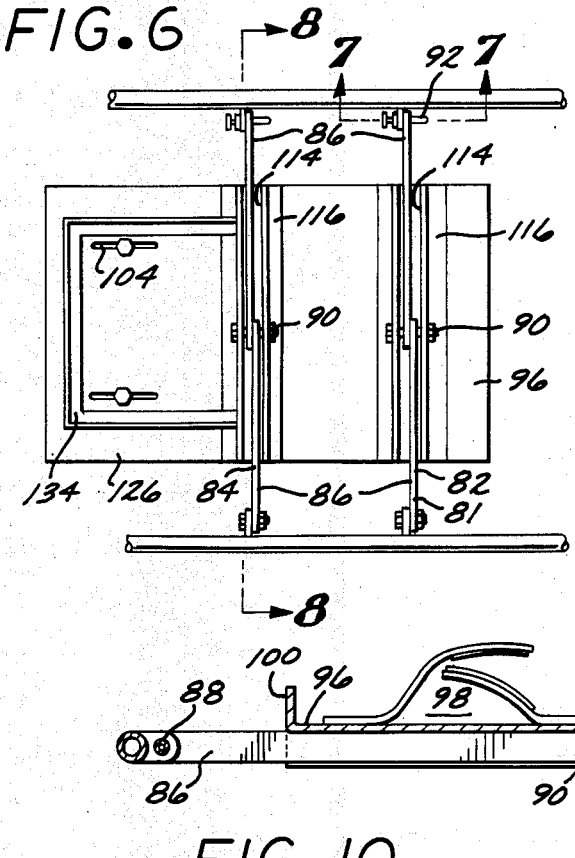
FIG. 7
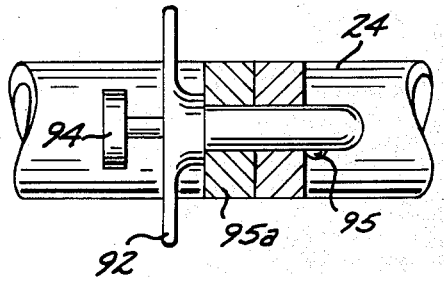
FIG. 8
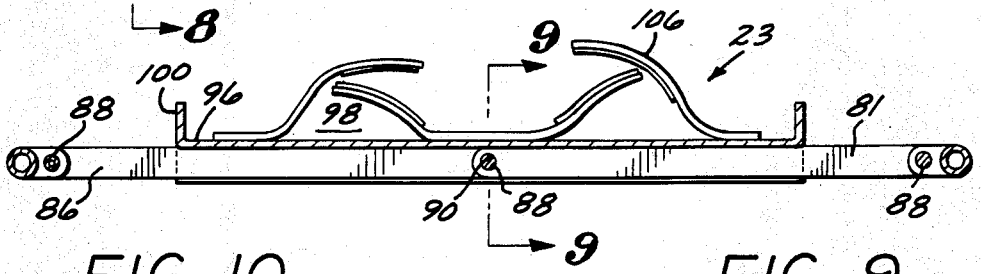
FIG. 10
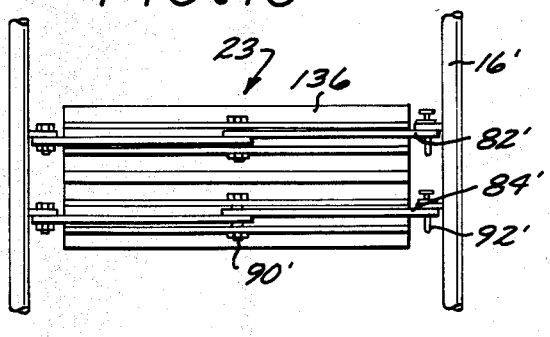
FIG. 9
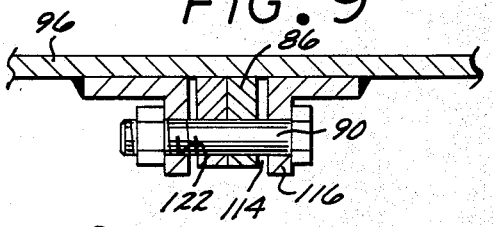
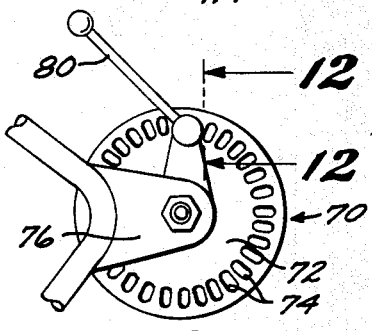
FIG. 11
FIG. 12
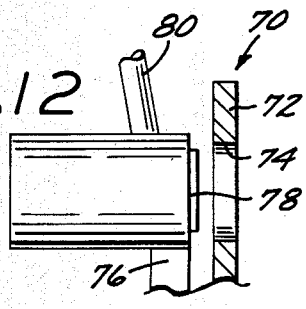
FIG. 13
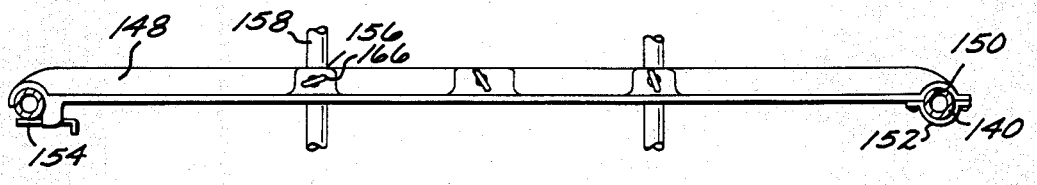

STANDING SUPPORT

BACKGROUND OF THE INVENTION

1. Field of the Invention

The present invention relates generally to improvements in standing supports and, more particularly, to a new and improved support for assisting persons paralyzed in their lower extremities in assuming a standing position and enabling such persons to move from one location to another under their own power.

2. Description of the Prior Art

Wheelchairs are used to move handicapped or disabled persons from one location to another. Conventional wheelchairs are constructed to transport the handicapped person in a sitting position. Such wheelchairs are usually configured as a chair supported by a tubular framework. A pair of relatively large drive wheels, rotatably mounted upon the framework are positioned so that hand rails attached to the wheels may be grasped by the user and rotated to move the wheelchair from one location to another. A pair of castered wheels are journaled to the framework to enable concurrent rotation about a horizontal and a vertical axis. When differential torque is applied to the drive wheels, the user can steer the wheelchair to effect a desired direction and movement.

In addition to the sitting wheelchair described above, devices have been configured which enable a paraplegic to propel himself while in a standing position. This enables the handicapped person to engage in other activities and interests that are unavailable in the sitting position. Furthermore, as a result of these standing support devices, the handicapped can now operate businesses and work at skilled trades where standing is required. One such standing support device is disclosed in the U.S. Pat. No. 3,107,105 to R. W. Heriford, issued Oct. 15, 1963. These standing supports generally have a pair of side frame members with cross bracing members joined therebetween. Hand wheels are rotatably mounted above and parallel to a pair of drive wheels. A chain assembly links the hand wheels to the drive wheels to enable a standing person to rotate the drive wheels as desired. Generally, the outermost transverse dimension of these vertical supports is about the same as conventional wheelchairs, e.g. about twenty-eight inches in width. As a result, these standing supports, as constructed, can move within the pathways and ramps constructed for the wheelchair-bound handicapped.

However, because of the structural configurations of the standing support devices and the conventional sit-down wheelchairs, i.e. outside dimensions are the same, the docking of conventional wheelchairs within the side frame members of the standing supports is obstructed by portions of the tubular framework and/or the drive wheel sub-assembly. As a result, self-transfer by a paraplegic from a conventional sit-down wheelchair to a standing support, or vice-versa, is unnecessarily difficult.

For these reasons, paraplegics or other handicapped persons who use supportive devices have long recognized the need for an improved standing support that enables the conventionally configured sit-down wheelchair to dock therewith, easing the transfer of the handicapped from one vehicle to the other. The present invention fulfills all of these needs.

SUMMARY OF THE INVENTION

Briefly and in general terms, a standing support of the present invention facilitates the docking of a conventional wheelchair therein while maintaining the outside dimensions required for easy travel in areas designed for wheelchairs. Basically, the present invention provides a new and improved standing support vehicle for paraplegics embodying a novel configuration which widens a rearward facing cavity between the side frame members while maintaining the outermost transverse dimensions of the drive wheels, and removes transverse obstructions therebetween so that a wheelchair can be inserted deeper into the longitudinal dimension of the standing support.

By way of example, and not necessarily by way of limitation, the standing support of the present invention includes an extension flange mounted upon a truncated lower horizontal member of the side frame member to laterally displace the drive wheel assembly outward relative to the side frame members while maintaining the required outermost lateral dimension of the drive wheel. Furthermore, a cantilevered foot pan mounted on a forwardly shifted cross brace member extending between the side frame members removes further obstruction to the docking with a conventional wheelchair, i.e. longitudinal insertion, within the rearwardly facing cavity. Hinged construction of the cross bracing enables the selective folding and disassembly of the standing support of the present invention. .A reversible winch assembly mounted to the framework aids in the self-transfer of the handicapped person from the wheelchair to the standing support device and vice-versa.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

FIG. 6 is an enlarged fragmentary bottom plan view taken along the lines 6—6 of FIG. 2;

FIG. 7 is an enlarged fragmentary sectional view taken along the lines 7—7 of FIG. 6;

FIG. 8 is an enlarged sectional view taken along the lines 8—8 of FIG. 6;

FIG. 9 is an enlarged fragmentary sectional view taken along the lines 9—9 of FIG.8;

FIG. 10 is a fragmentary front elevational view taken along the lines 10—10 of FIG. 2;

FIG. 11 is an enlarged fragmentary side elevational view of the brake assembly as shown in FIG. 1;

FIG. 12 is an enlarged fragmentary front elevational sectional view taken along the lines 12—12 of FIG. 11; and FIG. 13 is an enlarged fragmentary front elevational view taken along the lines 13—13 of FIG. 2.

DETAILED DESCRIPTION OF THE INVENTION

Figure 1:
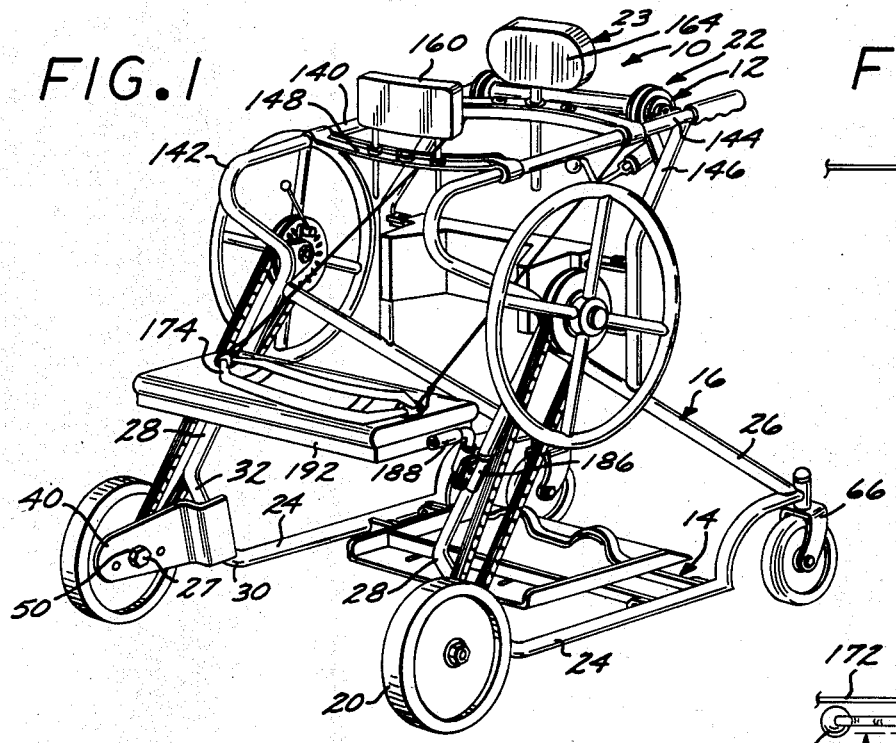
FIG. 1 is a perspective drawing of a standing support of the present invention.

Referring now to the exemplary drawings for the purposes of illustration, the improved standing support of the present invention, generally designated 10, includes a main frame generally designated 12. The main frame 12 includes cross bracing members, generally designated 14 extending between a pair of side frame members generally designated 16. The side frame members define a rearward facing cavity 17 therebetween. A propelling or chain-drive assembly, generally designated 18, including drive wheels 20, is mounted to the main frame to enable the user to selectively move the standing support from one location to another. A reversible winch assembly 22 is mounted to the side frame member 16 to facilitate the self-positioning of the paraplegic from a sitting position to a standing position. Various restraining assemblies, generally designated 23, are positioned upon the main frame, to support the handicapped operator within the main frame. For the purposes of illustration, the term "front" means the end towards which the handicapped operator faces when he or she is using the standing support.

Figure 2:
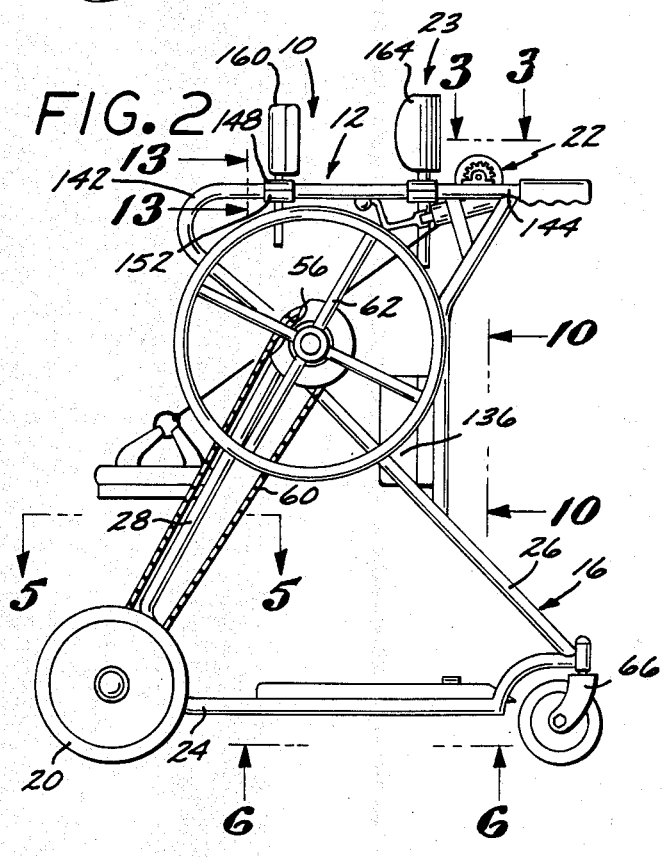
FIG. 2 is a side elevational view of the standing support of FIG. 1.
Figure 5:
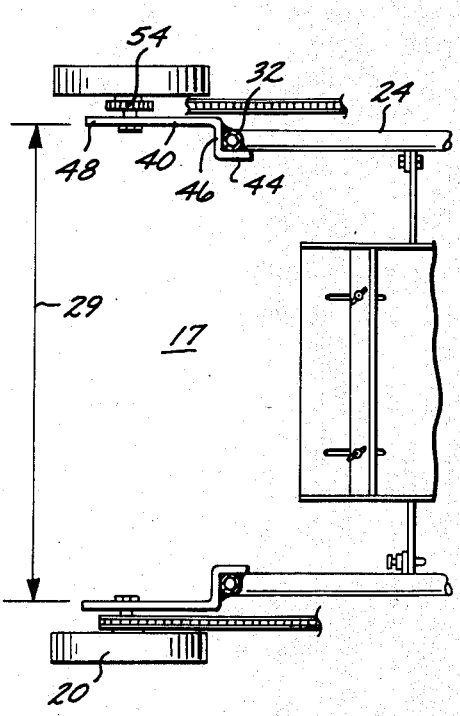
FIG. 5 is a fragmentary top plan view taken along the lines 5—5 of FIG.3.

Referring to FIGS. 1, 2 and 5, each side frame member 16 has an upper and lower end. The lower end includes a lower horizontal member 24 which longitudinally interconnects, along the bottom of the side frame member 16, the lower ends of a pair of front and rear upstanding members 26 and 28. In the preferred form, each back upstanding member extends upward and forward, while the forward upstanding member extends upward and rearward. To increase the transverse dimension of cavity 17, as indicated by the arrows 29 in FIG. 5, while maintaining the track or desired outermost transverse dimension of the drive wheels constant, i.e. to displace the interconnection of the drive wheels 20 transversely outward relative the side frame members to preserve of widen the cross-section of the cavity and yet retain the outermost lateral transverse dimensions of the side frames relative each other, the lower horizontal member of the present invention terminates at its rearward end in a first upward oblique bend 30 to angle the lower horizontal member upward. This configuration truncates or shortens the rearward extension of the lower horizontal member from the front of the standing support 10 as compared with conventional standing supports. A mounting or connecting member 32 extends upward and rearward from the first oblique bend to a second oblique bend 34 to join with the rear upstanding member 26. The front and rear upstanding members join together at an apex to define a generally triangular configuration.

An extension flange 40 is mounted upon the inside surface of the connecting member 32 of the lower end of the side frame member 16. The surface is generally parallel to the lower horizontal member 24. If the connecting frame is tubular, the inside surface is defined as that portion of the circumference whose tangent is generally laterally inward relative the side frame member. The extension flange is configured to displace the propelling assembly relative to the side frame members to minimize the combined transverse dimemsion of the propelling assembly and main frame. As best shown in FIG. 5, the extension flange has a generally Z-shaped vertical cross-sectional configuration, i.e. has a first generally planar side frame mounting plate 44, having an outer mounting surface, is positioned generally parallel to the lower horizontal member 24. The mounting plate is joined at one end of a generally orthogonal connecting plate 46, having a forward facing surface, to a second or drive wheel mounting plate 48, at the opposite end of the connecting plate, for the rotatable mounting on a stub axle 27 associated with the drive wheel 20. The drive wheel mounting surface 48 is generally parallel to the mounting plate and/or the lower horizontal member 24, but is displaced laterally outward relative to the planar mounting surface 46 and/or side frame 16. The drive wheel mounting surface has formed therein an axle bore 50 sized to receive a bearing therein. A plurality of axle bores may be provided allowing longitudinal adjustment of the standing support's wheel base. The stub axle is received through a central drive wheel bore and the bearing for each rotatable mounting. As a result, the stub axle is displaced laterally outward relative to the side frame member, increasing the transverse dimension of the cavity 17 defined therebetween.

Each of the drive wheels 20 is provided with a lower sprocket or drive gear 54 on the inside thereof. A pair of upper sprocket or drive gears 56 are journaled for rotation about aligned horizontal axes at the upper end of the side frame members. A flexible drive chain 60 is entrained about each pair of the correspondingly aligned sprocket gears. A pair of hand wheels 62 are coaxially mounted upon a hand wheel axes or concentrically mounted to one of the upper sprocket gears 56 for manipulation by a paraplegic to apply the desired torque to the appropriate drive wheel 20 and propel the standing support 10 from one location to another.

As an alternative to the hard wheel assembly shown, any of a variety of mechanisms useful to convert rotary or linear motion to rotation of drive wheels may be used to allow the operator to move the support from place to place. For example, lever or cam linkage (not shown) could be used instead f the hard wheels illustrated to provide a means easily accessable to the operator to remotely control the drive wheels 20.

The forward ends of the lower horizontal members 24 are each provided with a caster wheel assembly 66 journaled to said lower side frame member end to enable concurrent rotation about a vertical and horizontal axis whereby the support 10 may be steered by applying different amounts of torque to the rear wheels 20.

A hand brake assembly, generally designated 70, is best shown in FIGS. 11 and 12. Coaxially mounted upon the hand wheel axle or concentrically mounted to one of the upper sprocket gears 56, is a brake disc 72, having a plurality of disc apertures 74 formed circumferentially therein. A brake mounting flange 76 supports and positions a brake piston 78 coaxial and adjacent such disc apertures such that moving an actuating lever 80 from a first position to a second position extends the piston into one such aperture, preventing rotation of the brake disc and thus the upper sprocket gear, immobilizing the corresponding drive wheel 20.

As best shown in FIGS. 6, 8 and 9, the lower ends of the side frame members 16 are interconnected and maintained spaced apart from each other by lower cross bracing members 81. The lower cross bracing includes a front and rear hinged cross bracing members 82 and 84, respectively, each having a pair of hingedly connected arms 86 having cross member pin bores 88 formed at opposite ends. The arms are pivotally connected to one another by central pivot pin 90 received within the pin bores. Opposite arms ends are pivotally mounted to the side frame members 16. One end of the lower cross bracing members is releasably mounted to the side frame member by a ball release detent pin 92, as best shown in FIG. 7, to enable the easy disengagement of the cross member from the side frame member and allow rapid disassembly of the standing support member. The axial application of force to the plunger 94 withdraws the retaining ball 95 into the body of the pin, enabling the withdrawl of the detent pin from a flange 95*a* projecting from the lower horizontal member 24. As so configured, the lower cross bracing members can be folded upward to a V-shaped configuration to enable the collapsing of one side frame member towards the other from the spaced apart configuration.

Referring to FIG. 6, a cantilevered foot pan 96 including an upwardly opening recess 98 defined by upwardly projecting peripheral walls 100. A back wall 102 having bolts inserted through slots 104 formed within the foot pan, is longitudinally adjustable. The walls and bottom of the recesses are sometimes called heel restraint means. In addition, strap means 106 are mounted atop the foot pan to enable the restraint of the operator's feet. They permit limited horizontal movement of the feet, and also limit the horizontal position of the foot when slightly raised off the foot pan.

Formed in the bottom side of the foot pan 96 are a pair of channels 114 defined by downwardly depending walls 116 having foot pan pin bores 122 formed therein. The foot pan pin bores are positioned to correspond with the lower cross bracing central pivot pin 90 so that the pin 90 is concurrently received through the foot pan and cross member pin bores, to secure the foot pan to the hinged cross bracing members.

Referring to FIG. 10, an analogous structure enables the knee pad support assembly 136, extending between the side frame members 16, to fold and readily disassemble. The knee support assembly includes transverse cross bracing members 82' and 84' pivotally mounted on opposite ends, one end being releasably mounted by detent ball pins 92', to pivot about a central hinge pin 90' to enable the selective folding or disengagement of the knee-pad support assembly.

Referring to FIG. 6, in the present invention, the rear hinged cross bracing member 84 is disposed forward of the conventional cross bracing member location by about seven to about eight inches, to further remove or displace transverse obstructions to the docking forward, i.e. longitudinal insertion, of the conventional wheelchair within the cavity defined by the spaced apart side frame members 16 to a depth greater than possible within the cavity if the transverse obstructions were in their normal positions. A projecting shelf 126 of the foot pan extends rearward from the rear lower cross bracing member to support the handicapped persons feet without obstructing the longitudinal insertion of the conventional wheelchair within the cross members there across. Gussets 134 mounted on the bottom surface of the floor pan 112 reinforce the projecting shelf. By this configuration, the framework of the conventional wheelchair is not obstructed by the lower cross bracing members supporting the foot pan, when the wheelchair moves into the cavity 17 defined by the side frame members 16 during docking.

Referring to FIGS. 1 and 2, the upper end of the side frame members 16 includes a guard rail 140 extending upward and rearward from the rear upstanding member 28 through an arcuate gripping portion 142 which bends the guard rail to terminate in generally horizontal forward extension 144. A second front upstanding member 146 extends upward from the first upstanding member 26 to join and support the forward extension of the guard rail.

As best shown in FIG. 13, pivotal upper cross bracing members 148 extend transversely across from one side frame member 16 to the other. Recesses 150 are formed in the bottom surface of the upper cross members and sized to receive and engage the top surface of the guard rail 140 to maintain a spaced apart relationship therebetween. The upper cross bracing members are pivotally attached to the guard rails by the bolting of a clamp member 152, which, together with the recess formed in one end of the cross member, define a generally long transverse upper cross member bore sized to receive and pivotally mount to the forward extension 144 of one of the guard rails therein. The opposite end of the upper cross bracing member is releasably mounted or engaged to the corresponding portion of the other side frame member, e.g. the guard rail's forward extension, by a movable tab 154 which moves from a closed position, engaged with the guard rail's forward extension, to an open position, allowing the selective disengagement of the upper cross bracing member from the side frame member. By this configuration, the upper cross bracing members can be released and moved out of engagement with the side frame members and pivoted away therefrom. Mounting bores 156, generally perpendicular to the axes of the recesses, receive posts 158 attached to a back restraint or support 160 and a chest restraint or support 164 for removable mounting therein. The supports may be vertically adjusted by manipulation of a bolt 166 in thread engagement therewith. The knee and back restraints are positioned and arranged to simultaneously and respectively contact the front of both legs and along the ankles and the rear of the person above the knee joint while the person is in the standing position as described in U.S. Pat. No. 3,107,105 to Heriford.

Figure 3:
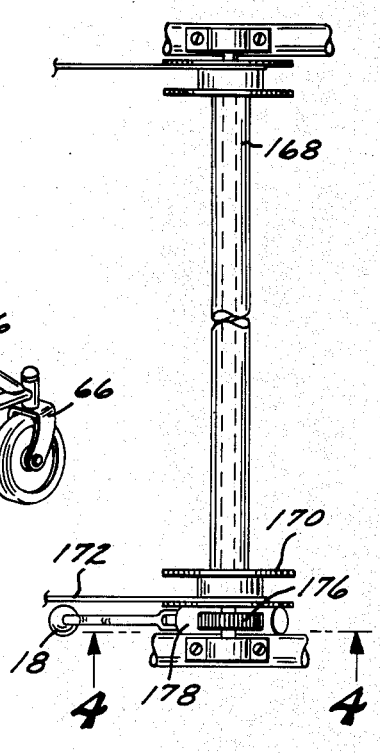
FIG. 3 is an enlarged fragmentary top plan view taken along the lines 3—3 of FIG. 2.
Figure 4:
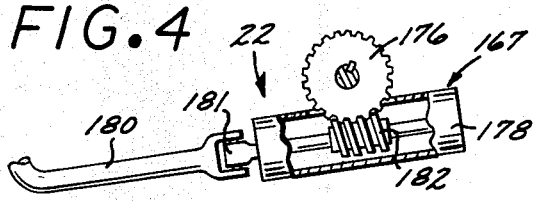
FIG. 4 is an enlarged fragmentary sectional side elevational view taken along the lines 4—4 of FIG. 3.

As best shown in FIG. 3, a winching assembly 167 is mounted to the main frame 12 for raising a human from a sitting position to a standing position. The upper ends of the side frame members 16 are transversely interconnected and spaced apart by means of a connecting rod 168 mounted therebetween. Disposed adjacent the side frame members and rotatably mounted upon the connecting rod 168 are take-up spools 170 for selective retrieval of sling straps 172 extending from opposite ends of a sling web 174. The belt ends are peripherally mounted to the take-up spool for winding thereon. The sling web is sized to engage with the handicapped person using the standing support 10. A take-up or retrieval gear 176 is coaxially mounted upon the connecting rod or concentrically to the take-up spool 170. A crank assembly 178, for translating rotatable motion about a generally longitudinal axis to rotatable motion about a generally transverse axis, is mounted on the connecting rod 168 and includes a hand crank 180 connected through universal joint 181, rotates a reversible worm gear 182, and take-up gear 176 in threaded engagement therewith, reversibly rotating the spool, retrieving the strap thereon. The universal joint helps ease the cranking by allowing the axis crank handle rotation to adjust to the up or down positioning of the operator. The portion of the connecting rod between take-up spools 170 is covered with shock absorbing material such a close-cell foam.

Referring to FIG. 1, a pair of clamps 186 sized to engage or receive the rear upstanding members 26, are formed with mounting bores 188 sized to receive and thus removably mount a seat platform 192 thereon.

In operation, the support device of the present invention is parked in the desired position and the hand brake assembly 70 set so that the standing support 10 will not move. A wheelchair of conventional construction having a handicapped person sitting thereon is manuevered within the rearward facing cavity 17 defined by the sideframe members 16. Because of the lateral displacement effect of the extension flange 40, the transverse dimension of the cavity is widened to permit the docking of the conventional wheelchair therein. In addition, because the rear lower cross bracing member 84 is moved forward as compared with conventional standing supports and because the foot pan 96 is of a cantilevered configuration, the transverse obstructions to the insertion of the wheelchair deeper within the cavity are removed. As a result, the handicapped person has to transfer himself over a shorter distance than with conventional standing support devices.

After docking, the paraplegic transfers his feet from the wheelchair to the foot pan 96, positions his feet in the upwardly opening recess 98, and pulls himself to an upright standing position by grasping and pulling on portions of the main frame, e.g. the gripping portion 142 of the guard rail 140, or on the "handle means", depending upon individual circumstances. Alternatively, the operator may position the sling web 174 about himself and use the crank assembly 178 to aid in the transfer from one vehicle to the other by helping lift the user from a sitting position to a standing postion. The back restraint 160 is then rotated to an operational position. The knee and back restraints 136 and 160, respectively, are then positioned to simultaneously and respectively contact the front of both legs above the ankles, and the rear of the human above the knee joint while the human is in the standing position. The hand wheels 62 may then be manipulated to propel the standing support 10 from one location to another. The standing support 10 may be steered by effecting varying amounts of torque to the hand wheels 62.

While particular forms of the standing support of the present invention have been illustrated and described in some detail herein, various modifications may be made without departing from the spirit and scope of the present invention. Accordingly it is not intended that the invention be limited except as by the appended following claims.

What is claimed is:

1. A standing support for docking with a conventional wheelchair used by handicapped humans, comprising:

a main frame including a pair of spaced apart side frame members having upper and lower ends, said side frame members defining a cavity sized to receive a conventional wheelchair therebetween;

a plurality of drive wheels, each of which is rotatably mounted upon an associated stub axle, said drive wheels providing means to move said standing support;

extension means mounted upon said lower ends of each of said frame members for the mounting of said stub axles thereupon, said extension means providing means to maintain a desired outermost transverse dimension of said drive wheel and said frame while increasing the unobstructed cross-section of said cavity; and upper and lower cross bracing means for interconnecting, respectively, said upper and lower ends of said side frame members.

2. A standing support for docking with a conventional wheelchair used by handicapped humans, comprising:

a main frame including a pair of spaced apart side frame members having upper and lower ends, said side frame members defining a cavity sized to receive a conventional wheelchair therebetween;

a plurality of drive wheels each of which is rotatably mounted upon an associated stub axle, said drive wheels providing means to move said standing support;

extension means mounted upon said lower ends of each of said side frame members for the mounting of said stub axles thereupon, said extension means providing means to maintain a desired outermost transverse dimension of said drive wheel and said frame while preserving the cross-section of said cavity;

upper and lower cross bracing means for inter-connecting, respectively, said upper and lower ends of said side frame members, said lower cross bracing member being positioned towards the forward end of said standing support; and a cantilevered floor pan mounted upon said lower cross bracing member to displace transverse obstructions to docking forward within the standing support, to enable longitudinal insertion of said conventional wheelchair within said cavity to a depth greater than that possible if said transverse obstructions were in their normal positions.

3. A standing support as set forth in claim 2 wherein said main frame includes front and rear upstanding members extending upwards from said lower side frame members, and wherein said lower side frame end includes a truncated lower horizontal member extending longitudinally along the bottom of said side frame member and terminating at a rear end in a first oblique bend;

a mounting member extending upward and rearward relative said lower horizontal member from said first bend to terminate in a second bend joining said mounting member with said rear upstanding member; and said extension means includes an extension flange having one end mounted to said mounting member, said mounting member having a bore for receipt of said stub axle for rotatable mounting of said drive wheels thereon.

4. A standing support as set forth in claim 3 wherein said winching means includes a sling means for engaging the human being raised, said sling means having a plurality of straps and a winch assembly, mounted to said main frame, said straps secured to said winch assembly for retrieval of said straps thereon.

5. A standing support as set forth in claim 4 wherein said winching means includes a reversible worm and gear assembly, mounted to said main frame for translating rotation about one axis to a second axis.

6. A standing support as set forth in claim 3 wherein said side frame has an inside side frame surface generally parallel to said lower horizontal member; and wherein said extension flange includes a first mounting plate generally parallel to the side frame members mounted to said inside side frame surface, a second mounting plate generally parallel to said first plate, and a connecting plate having a forward facing surface joined at opposite ends to said first and second mounting plates, extending generally orthogonal thereto, said second mounting plate having a bore formed therein sized to receive said stub axle therein to laterally displace said stub axle outward relative to said side frame member and increase the transverse dimension of said cavity defined therebetween.

7. A standing support as set forth in claim 2, including winching means mounted to said main frame for raising the human from a sitting position to a standing position.

8. A standing support as set forth in claim 7 wherein said lower cross bracing means each include a pair of hingedly connected arms each having an opposite end pivotally mounted to said lower ends; and wherein said upper cross bracing means includes a member having a bore sized to receive and pivotally mount to a portion of said main frame, and a releasable engaging means positioned on the opposite member end from said bore, whereby said upper cross bracing is released and moved out of engagement with said side frame member and pivoted away therefrom and said lower cross engaging member folds upward to a v-shaped configuration to enable the collapsing of one side frame member towards the other from the spaced apart configuration.

9. A standing support for docking with a conventional wheelchair used by handicapped persons, comprising:

a main frame including a pair of spaced apart side frame members having upper and lower ends, said lower end including a lower horizontal member extending longitudinally from the front end to the rear end, and said side frame members defining a cavity sized to receive a conventional wheelchair therebetween;

means for propelling said standing support from one location to another;

an extension flange mounted upon a lower horizontal member of said side frame member, said extension flange configured to displace said propelling means outward relative to said side frame members to minimize the combined transverse dimension of said propelling means and said frame, to increase the internal lateral dimensions of said cavity; and upper and lower cross-bracing means interconnecting said upper and lower ends of said side frame members, such that a conventional wheelchair can dock within said cavity defined between said side frame members.

10. A standing support device for humans as set forth in claim 9 wherein said cross bracing means interconnecting said side frame member lower ends; and a cantilevered floor pan mounted upon said lower cross-bracing means, for supporting the human feet while reducing the transverse obstructions between said side frame members so that said conventional wheelchair may dock further within said cavity.

11. A standing support for humans as set forth in claim 10 including a connecting rod extending between said side frame members, retrieval means mounted to said connecting rod, and a belt engaged with said human, said belt having an end mounted to said retrieval means so that said belt is selectively wound upon said retrieval means to lift the human from a sitting position to a standing position.

12. A standing support for humans as set forth in claim 11, wherein said retrieval means includes a spool mounted on said connecting rod, for mounting of the belt end peripherally thereon, a retrieval gear coaxially mounted upon said connecting rod; a worm gear assembly threadingly engaged with said retrieval gear, and a crank handle and a universal joint, said crank handle joined to said worm gear assembly through said universal joint so that rotation of the crank handle rotates the worm gear assembly, retrieving the belt upon said spool.

13. A standing support as set forth in claim 9 wherein said cross-bracing means includes a pair of cross members pivotally mounted to one side frame member on one end and releasably engaged with the other side frame member at the other end of such cross members.

14. A standing support for docking with a conventional wheelchair used by handicapped persons, comprising:

a main frame including a pair of spaced apart side frame members having upper and lower ends, said lower end including a lower horizontal member extending longitudinally from the front end to the rear end, and said side frame members defining a cavity sized to receive a conventional wheelchair therebetween;

means for propelling said standing support from one location to another;

an extension flange mounted upon a lower horizontal member of said side frame member, said extension flange configured to displace said propelling means relative to said side frame members to minimize the combined transverse dimension of said propelling means and said frame;

upper and lower cross-bracing means interconnecting said upper and lower ends of said side frame members, said cross bracing means includes a pair of arms pivotally connected to one side frame member at said lower horizontal member and releasably engaged with the other side frame member at the other end of such arms; and

15. A standing support as set forth in claim 14, wherein said cross bracing includes a front and a rear cross brace extending from one said side frame member to the other, said rear cross brace disposed generally medially relative to said floor pan to project a portion of said cantilevered floor pan rearward, unobstructed by said cross bracing means and thus aiding the docking of a conventional wheelchair within said cavity.

16. A standing support as set forth in claim 15 including a chest and back restraint mounted upon said said upper cross bracing members.

17. A standing support as set forth in claim 16 including a knee restraint extending between said side frame members.

18. A standing support for docking with a conventional wheelchair used by handicapped persons, comprising:

a main frame including a pair of spaced apart side frame members having upper and lower ends, said lower end including a lower horizontal member extending longitudinally from the front end towards the rear end, and said side frame members defining a cavity sized to receive a conventional wheelchair therebetween;

a drive wheel, a lower drive gear and a stub axle, said lower drive gear concentrically mounted to said drive wheel, both of which are mounted upon said stub axle;

an extension flange mounted upon a lower portion of said side frame member, said mounting flange having a bore sized to receive said stub axle therein to rotatably mount said drive wheel to said side frame member, and configured to increase the transverse dimension of said cavity defined therebetween while minimizing the outside transverse dimension of said standing support;

a hand wheel and a top drive gear, said top drive gear mounted to said hand wheel, both of which are rotatably mounted to said main frame, and a drive chain, said top drive gear aligned with said lower drive gear and entrained by said drive chain such that rotation of said hand wheel applies torque to said drive wheels;

a connecting bar extending across said upper ends, a pair of spools concentrically mounted upon said connecting bar, a crank assembly mounted upon said connecting bar and engaged with one of said spools, and strap means sized to engage with the handicapped person using the standing support such that the crank assembly is actuated to retrieve the belt mounted to said spool and aid in the raising of the person from a sitting position to a standing position;

a front and a rear upper cross bracing members pivotally mounted at one end to said side frame members and releasably mounted at its opposite end to said other side frame member, said upper cross bracing members having a plurality of bores formed therein, a back restraint mounted upon posts for receipt within said bores of said rear upper cross member, and a chest restraint mounted upon a post for receipt within said bores of said front upper cross member; and a front and a rear lower cross bracing members each having a pair of arms hingedly connected at one end to each other and pivotally connected to said lower horizontal members of said side frame members, and a cantilevered floor pan including a pair of walls mounted on the bottom surface of said floor pan to define a channel therebetween sized to receive said lower cross bracing members therein and having a bore therein, and a hinge pin received within said bore and said lower cross bracing members, enabling the folding of said arms into a v-shaped configuration and allowing the movement of said side frame members inward towards each other.

* * * * *